United States Patent [19]

Wyatt

[11] 4,288,978

[45] Sep. 15, 1981

[54] VAPOR GENERATOR

[75] Inventor: William G. Wyatt, Arlington, Tex.

[73] Assignee: Vapor Energy, Inc., Grand Prairie, Tex.

[21] Appl. No.: 37,029

[22] Filed: May 8, 1979

Related U.S. Application Data

[63] Continuation-in-part of Ser. No. 907,694, May 19, 1978.

[51] Int. Cl.[3] ..... F02C 7/26

[52] U.S. Cl. ..... 60/39.05; 60/39.14 R; 60/39.55; 60/39.82 P; 431/281

[58] Field of Search ..... 60/39.14 R, 39.82 P, 60/39.55, 39.05; 431/281

[56] References Cited

U.S. PATENT DOCUMENTS

| | | | |
|---|---|---|---|
| 543,501 | 7/1895 | Nordberg et al. | 60/39.82 P |
| 1,531,475 | 3/1925 | Brandt | 60/39.55 |
| 3,073,121 | 1/1963 | Baker et al. | 60/39.82 P |
| 3,691,759 | 9/1972 | Scheerer | 60/39.14 R |

*Primary Examiner*—Louis J. Casaregola
*Attorney, Agent, or Firm*—Thomas L. Cantrell; Joseph H. Schley; Stanley R. Moore

[57] ABSTRACT

Disclosed is an improved vapor generator of the kind in which a fuel-air mixture is combusted in a chamber through which water is flowed. The water acts as a coolant for the unit and is vaporized or converted to steam in the chamber in the presence of the flame. The steam formed from the feed water, the steam formed as a product of combustion, and the non-condensibles remaining after combustion issue from the chamber as a hot mixture suitable for a variety of uses, such as process steam, comfort-heating steam, and the like. The improvements include means for dividing the air feed into two parts, and means for forming a well-mixed stoichiometric mixture of fuel and the air of one part, which mixture is ignited and burned in a prechamber surrounded by and cooled by the air of the other part. The second part of the air is fed into the midregion of the soformed flame in the main chamber to lean it out and insure completeness of combustion, reducing production of carbon monoxide to extremely low levels. The mid-region of the flame is shielded from direct radiative or convective contact with the feed water flowing into the main chamber. The final region of the flame is brought into good direct radiative and convective contact with the feed water to vaporize it. The generator is especially adapted for low pressure operation by the provision of a pilot burner for striking a stable flame.

2 Claims, 4 Drawing Figures

VAPOR GENERATOR

This application is a Continuation-in-part of my copending U.S. patent application Ser. No. 907,694, filed May 19, 1978, entitled IMPROVEMENTS IN VAPOR GENERATORS now U.S. Pat. No. 4,211,071, issued July 8, 1980.

BACKGROUND OF THE INVENTION

Vapor generators of the kind in which a fuel-air mixture is combusted in the direct presence of feed water to produce a useful mixture of steam and non-condensibles are known. See the vaporizers shown in U.S. Pat. No. 3,980,137 and British Pat. No. 283,290. Other similar equipment is shown in U.S. Pat. Nos. 1,483,917; 2,168,313; 3,101,592 and 3,449,908.

One difficulty which has been encountered in vaporizers in the past is that of high carbon monoxide content in the product vapor, which is objectionable for many applications and dangerous for some of them. High carbon monoxide production is traceable to incomplete combustion, which is in turn traceable in part to difficulties in maintaining a stable lean flame, and in part to excessive quenching of the flame through direct radiative and convective contact between the flame and the feed water.

Another disadvantage of past vapor generators is encountered especially when they are operated at low pressures. Conventionally, as shown in my prior copending application Ser. No. 907,694, vapor generators are started by spark ignition. A spark plug is provided, and it is activated for starting. After spark activation, flow of fuel and air to the combustion chamber is commenced, and the spark strikes a flame in the flowing mixture. However, it may happen that a combustible mixture partially fills the combustion chamber before combustion begins. In such case, a small explosion occurs in the combustion chamber when the flame is struck. The explosion is characterized by a rapid rise in temperature and pressure.

When the generator is one in which the fuel and air supply pressures are relatively high (e.g. 100 psig) compared to the combustion chamber pressure (e.g. 20 psig), sonic velocity is attained in the air and fuel delivery system, and the small explosion upon ignition causes little or no problem.

But when the generator is one in which the fuel and air supply pressures are relatively low (e.g. 10 psig) compared to combustion chamber pressure (e.g. 5 psig), the pressure pulse accompanying the small explosion may cause a change in the fuel/air ratio or even momentarily stop fuel and/or air flow. This results in undesirable rough combustion. Combustion proceeds by a series of small explosions, instead of in a smoothly established flame.

SUMMARY OF THE INVENTION

In accordance with the present invention a vapor generator is provided in which several inter-related means are employed to improve the quality of combustion in the generator so that a product stream substantially free of carbon monoxide results. In its preferred form, air (or another combustion supporting gas such as pure oxygen) is compressed and fed into a conduit system leading to the vaporizer. The conduit system includes a main line and a branch line, both of which are provided with suitably sized orifice plates for dividing the air into a main feed stream and an auxiliary feed stream in a selected volumetric or mass ratio.

Immediately downstream of the main air stream orifice, fuel is introduced into the main line at a rate sufficient to form a stoichiometric mixture with the air passing through the main line. The preferred fuel is gaseous, such as natural gas or hydrogen. By introducing the fuel in the turbulent region downstream from the main line orifice plate, assurance is obtained that good mixing of the fuel and air will result. Further assurance of good mixing is obtained by passing the fuel-air mixture through a relatively long length of conduit between the point of formation of the mixture and its point of ignition. Preferably, the stretch of conduit devoted to mixing includes at least one right angle bend, which serves to cause additional turbulence.

The stoichiometric fuel-air mixture is then introduced into a precombustion chamber where it is ignited. When the air and fuel supply pressure is sufficiently higher than the pressure in the precombustion chamber, the rate of feed is faster than the flame propagation speed so that the flame does not migrate upstream into the conduit. The precombustion chamber includes a cylindrical flame-confining skirt within it. The auxiliary air feed stream is fed through its conduit into the annular space between the skirt and the outer wall of the precombustion chamber, where it cools the skirt and is itself preheated.

The precombustion chamber, in the preferred embodiment, is mounted at the upper end of the vaporizer unit itself, which comprises the main combustion chamber. The vaporizer unit is preferably an upright cylinder having an annular water jacket therearound. Water is fed into the lower end of the jacket, through which it flows upwardly, and at the upper end of the jacket it is fed into the main combustion chamber and directed downwardly along the chamber walls.

The precombustion chamber is positioned with respect to the main combustion chamber so that the flame struck in the prechamber extends downwardly into the main combustion chamber. The auxiliary preheated air stream escapes from the annular space in the precombustion chamber by flowing past the bottom edge of the flame confining skirt and enters the main combustion chamber, where it joins the flame. The addition of exess air (or oxygen) to the flame serves to lean it out and provide sufficient oxidizing material to convert substantially all the carbon in the fuel to carbon dioxide, instead of converting some fraction of it to carbon monoxide.

In the upper end of the main combustion chamber a second depending cylindrical flame confining skirt is provided. This skirt shields the portion of the flame adjacent the upper end of the chamber from full convective and radiative contact with the film of feed water flowing down the inner wall of the vaporizer. In this manner, excessive cooling or quenching of this portion of the flame is prevented, which contributes to the attainment of complete combustion.

In the main combustion chamber the flame extends downwardly past the lower end of the main chamber flame confining skirt. Thus the bottom portion of the flame is in full radiative and convective contact with the feed water flowing down the chamber wall. The feed water vaporizes and joins the hot combustion products (steam and noncondensibles) to form the product stream, which leaves the vaporizer via a conduit connected to its bottom. A valve is included in the outlet conduit to provide a means for controlling back pressure in the vaporizer.

In addition to providing extremely good combustion efficiency and low concentrations of carbon monoxide, the vaporizer of the invention retains the excellent heat efficiency characteristic of earlier forms of vaporizer.

From the foregoing discussion, it can be seen that in accordance with the invention a three-zone flame is established and maintained in the vaporizer: in the first zone, a stoichiometric mixture is ignited and burned under shielded conditions which insure flame stability; in the second zone, excess air is introduced to the flame under shielded conditions to insure completion of combustion; and in the third zone the flame is exposed to the feed water to vaporize it and quench the flame, after combustion has been completed.

In accordance with another aspect of the invention, an improved vapor generator is provided which is particularly suited for operation at low pressures, including low fuel and air delivery pressures. Instead of a direct spark ignition system, as in past practice, a pilot burner is provided with a separate combustion chamber positioned to project the pilot flame into the precombustion chamber. The pilot burner has its own fuel and air supply and is spark ignited.

In addition, in accordance with the invention, the starting procedure is changed so that the combustion chamber is first purged for a selected period to remove any residual combustible mixture. Fuel and air are then delivered to the pilot burner, and are spark ignited there. Fuel flow of the precombustion and combustion chambers is then commenced. A flame detector, such as an ultra-violet sensor, is positioned to detect the main flame struck by the pilot flame in the precombustion chamber. When the main flame is detected, the fuel and air flow to the pilot burner is discontinued. Preferably, means are provided to recycle the unit through this starting sequence one time if no main flame is detected. If no flame is successfully struck during the recycle stage, the equipment is shut down and an alarm is sounded.

By use of a pilot burner, it is necessary to ignite only a small amount of fuel-air mixture initially. This means that the pressure pulse from the striking of the flame is correspondingly small and not disruptive of flow, even at low feed stream pressures. At the instant the pilot flame is struck, only air is being fed to the precombustion and combustion chambers. Fuel flow starts later, and by the time a fuel-air mixture reaches the precombustion chamber, the pressure pulse has been dissipated.

Furthermore, the portion of the pilot flame projecting into the precombustion chamber is relatively much larger than any spark struck by a spark plug. When the main fuel-air mixture reaches the precombustion chamber, it is almost instantaneously ignited by this larger flame, before a large volume of combustible mixture can accumulate in the combustion chamber and precombustion chamber. This results in full ignition of the main flame with substantially no pressure surge disruptive of fuel-air flow, even at very low pressures.

DESCRIPTION OF A PREFERRED EMBODIMENT

Figure 1:
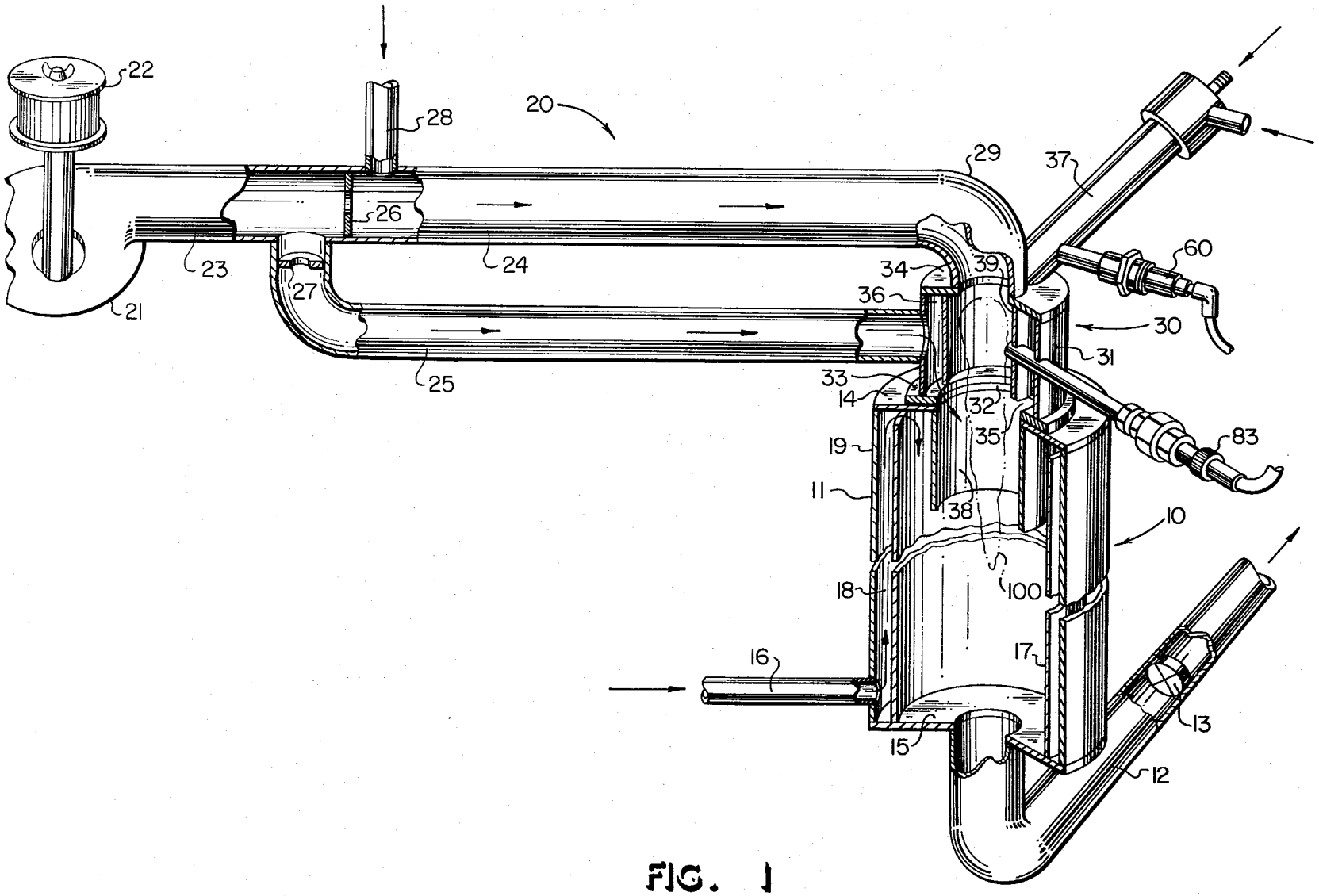
FIG. 1 is a somewhat diagrammatic illustration, partly in elevation and partly in perspective, of a vaporizer constructed in accordance with the invention.

In FIG. 1 the vaporizer of the invention is designated generally as 10. The primary component thereof is the vaporizer proper or main combustion chamber 11. Chamber 11 is preferably an upright closed-ended elongated cylinder adapted to enclose the bulk of the flame generated in accordance with the invention. To the bottom of chamber 11 is connected a product exit line or conduit 12, in which is mounted a back-pressure control valve 13, which is shown quite diagrammatically.

Chamber 11 has a cylindrical outer wall 19, and closed ends 14, 15. Provision is made for the delivery of feed water to the interior of the main combustion chamber. These provisions include water inlet line 16, and internal cylindrical wall or tube 17. Tube 17 is attached to bottom end 15 and terminates a selected relatively small distance short of top end 14. An annular space 18 is thus established between walls 19 and 17 extending over substantially the full height of chamber 11.

In operation, feed water is delivered into annular space 18 through inlet line 16. The water cools the unit and is warmed as it rises through the annular space or jacket 18. The water then spills over the top edge of tube 17, and flows down its inner wall. As will be explained more fully hereinbelow, during the first part of the downward travel, the water absorbs heat conductively from a shielded portion of the flame. During the final part of its downward flow, the feed water is in direct radiative and convective contact with part of the flame, and is vaporized thereby to form steam that becomes part of the product stream leaving chamber 11 via conduit 12.

The fuel and air delivery system of the invention is designated generally as 20. It includes an air compressor 21, having an air filter 22, both of which are shown diagrammatically. Various types of compressors having suitable output pressures and delivery rates may be employed. The compressed air issuing from compressor 21 enters conduit 23.

The compressed air stream in conduit 23 is divided into two streams bearing a selected ratio (volumetric or mass) to each other. The division is accomplished by providing mixing conduit 24, which is an extension of air conduit 23, and branch or auxiliary air conduit 25. Conduits 24 and 25 are each connected to the precombustion chamber discussed more fully hereinbelow. Air flow dividing orifice plates 26 and 27 are mounted in conduits 24 and 25 adjacent the branching or division point, and the orifices in the plates are sized to bring about the desired division of the air flow. Preferably, the flow through auxiliary air conduit 25 amounts to about 8 to 10 percent of the air flow through mixing conduit 24.

Immediately downstream of orifice plate 26 in mixing conduit 24 there is provided a fuel inlet 28. Flow in conduit 24 just downstream of the orifice in plate 26 is quite turbulent, and it is desirable to introduce the fuel at the point to initiate thorough and intimate mixing of the fuel and air. Furthermore, it is preferred that mixing conduit 24 be fairly long in order to provide a full opportunity for thorough mixing of the air and fuel stream before it reaches the precombustion chamber. Mixing is also enhanced by the directional change in conduit 24 at bend or elbow 29. The diameter of mixing conduit 24 is selected in view of the desired flow rate so that the lineal velocity of mixture flowing therethrough is substantially equal to or slightly greater than the flame propagation speed, so that the flame established and maintained in the precombustion chamber will not migrate back up into conduit 24 or its bend 29. For example, with a designed fuel flow of 17 cubic feet per minute, mixed with a stoichiometric quantity of air, a nominal conduit diameter of about 2 inches is satisfactory.

The precombustion chamber of the invention is designated generally as 30. It includes a cylindrical housing 31, somewhat larger in diameter than opening 32 in the upper end 14 of chamber 11. Housing 31 is attached to upper end 14 by means of flange 33. The upper end of housing 31 is closed by plate 34. A flame enclosing skirt or shield 39 depends downwardly from plate 34, terminating short of opening 32 and flange 33 so that a circular slot 35 is defined between the edge of the skirt and the edge of the flange. A cylindrical annular space 36 is defined by skirt 39 and housing 31. Conduit 24 is attached to the top of the precombustion chamber to deliver a fuel-air mixture into the space within shield 39, and conduit 25 is attached to the side of the precombustion chamber to deliver auxiliary air into annular space 36.

A pilot burner assembly 37 is mounted on precombustion chamber 30 so that its mouth opens into the chamber near the junction of conduit 24 and plate 34, and within skirt 39.

In the vaporizer 11, a second flame enclosing shield or skirt 38 is mounted on top end 14 to depend downwardly from opening 32.

Figure 2:
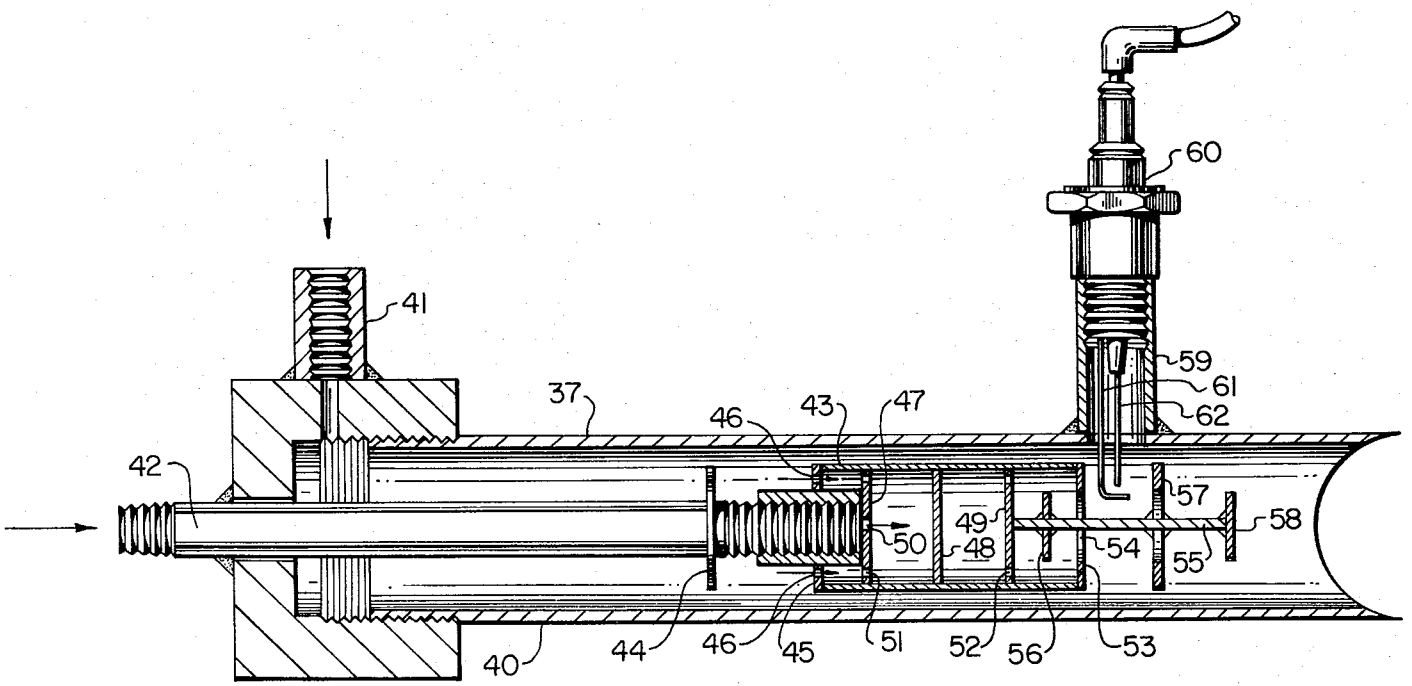
FIG. 2 is a cross sectional elevational view of the pilot burner system of the unit of FIG. 1.

The structure and operation of the pilot burner assembly 37 can be understood from FIG. 2. It comprises a cylindrical housing 40, having an air inlet 41 and a fuel gas line 42. Air is fed directly into the interior of housing 41, where it flows toward the right as FIG. 1 is drawn. Gas line 42 delivers gas into one end of pilot mixer 43, which is mounted on the end of line 42. Baffle 44 is mounted on the exterior of line 42 somewhat upstream of mixer 43 to limit the quantity of air entering the mixer.

The pilot mixer has plate 45 closing its upstream end. A circumferentially arranged series of apertures 46 are provided in plate 45 for admitting air into the mixer. Internally, mixer 43 is provided with three apertured plates 47, 48, 49. Gas line 42 terminates against plate 47 and discharges fuel gas therethrough via central aperture 50.

Each of plates 47, 48 and 49 is provided with a circumferentially arranged series of apertures which are angularly offset from one plate to the next to provide a tortuous mixing flow path for gas and air flowing through the mixer. The apertures in plate 47 are designated 51 and those in plate 49 are designated 52, but those in plate 48 do not show in FIG. 2 because of the line at which the section is taken. The downstream end of mixer 43 is provided with an end plate 53 having a relatively large exit opening 54. A flat bar 55 is cantilevered outwardly from plate 49 through opening 54. Within mixer 43 it carries baffle 56, while beyond the end of mixer 43, it carries ring baffle 57 and disc baffle 58.

Housing 40 is provided with a side branch 59 in which is mounted spark plug 60. The electrodes 61, 62 of the spark plug extend into the space between the downstream end of mixer 43, and ring baffle 57.

In operation, a portion of the air flowing through housing 40 is aspirated into mixer 43 through apertures 46, where it mixes with fuel gas entering through apertures 50. The passage of the gas and air through the series of baffles insures formation of an intimate mixture, which is slightly rich as it issues from the mixer through opening 54. It is there ignited by the spark struck between electrodes 61, 62. The pilot flame thus formed receives excess air which has flowed through housing 42 outside mixer 43, and issues from the right-hand end of burner assembly 37 into the precombustion chamber.

Figure 3:
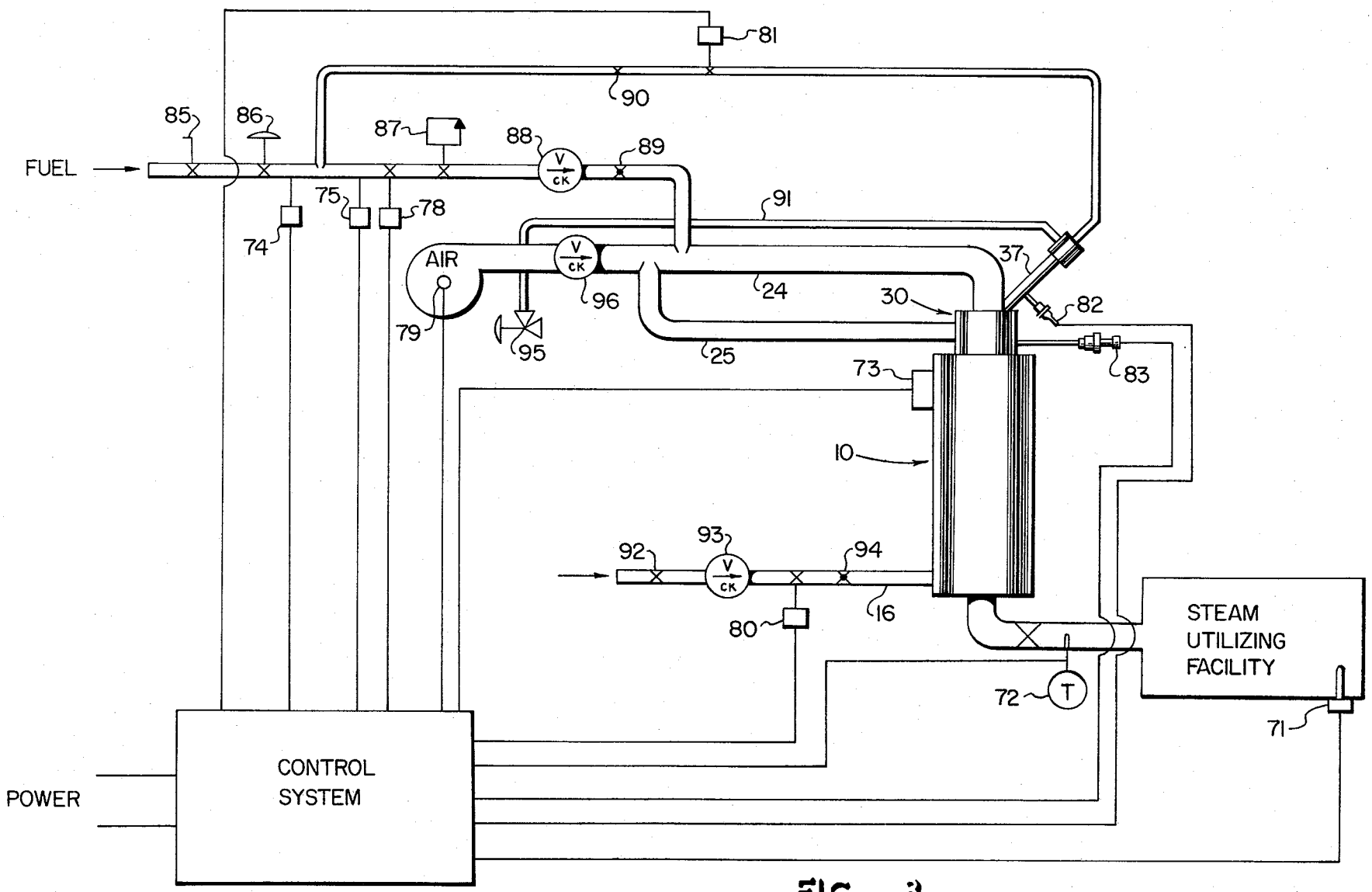
FIG. 3 is a diagrammatic elevational view of the vapor generator of FIG. 1, illustrating various control and monitoring elements.
Figure 4:
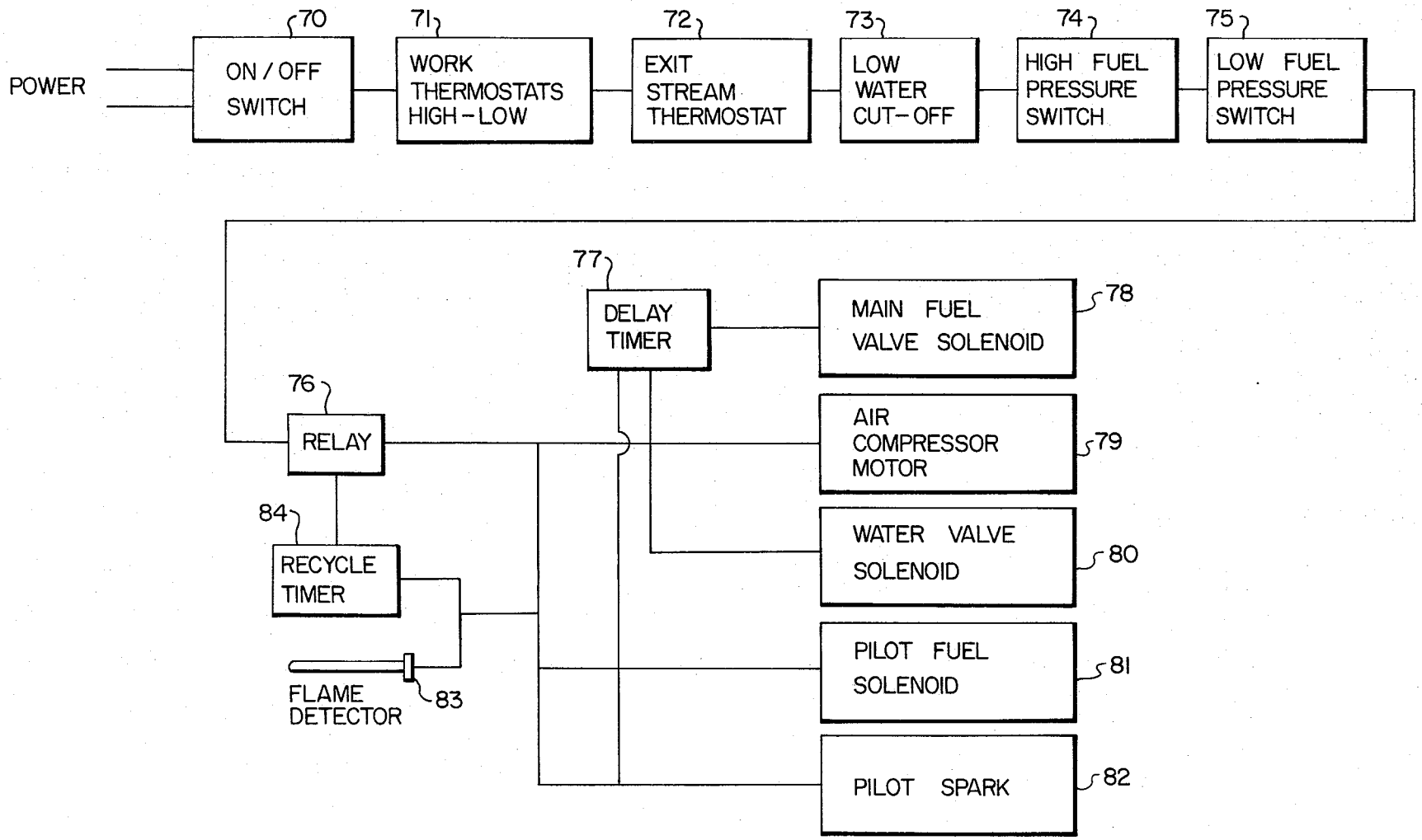
FIG. 4 is a block diagram of the control system for the vapor generator of FIG. 1

Attention is now directed to FIGS. 3 and 4, which, taken together illustrate diagrammatically those aspects of the invention involving control of the vapor generator process. As can be seen from the foregoing discussion, three primary input streams are involved: Fuel gas; combustion supporting gas (preferably air from an electrically driven blower or compressor); and water. There are thus three primary points of control: main fuel valve 78, air compressor motor 79 (and particularly its on-off mechanism), and the water valve solenoid 80. During start-up, fuel gas and sparking current are supplied to the pilot burner, and the pilot gas solenoid 81 and pilot spark 82 (more precisely the sparking circuit switch) thus form two additional points of control.

The equipment is provided with a manual on-off control 70, and a series of monitoring devices which monitor various operating conditions and turn the generator off, or prevent its start-up if it is already off, when a condition departs from a desired value or range of values. As can be seen from FIG. 4, the monitors include work thermostats 71, exit thermostat 72, low water level sensor 73, high fuel pressure switch 74 and low fuel pressure switch 75, all of which are in series between the source of electric power and the above mentioned five points of control.

The physical locations of the monitors may be seen from FIG. 3. The work thermostats 71 are located at or near the point of use of the vapor, for example in a concrete curing kiln. They serve to cycle the generator on and off to maintain the temperature at the point of use with a desired range. The exit stream thermostat 72 is positioned in the exit conduit, and acts to turn the generator off of the temperature exceeds a selected value. An excessive exit stream temperature is indicative of an excessive temperature within the generator. The low water level sensor 73 is positioned at the top of the water jacket of the generator, and acts to turn the generator off if some defect in the water supply causes the jacket to be less than full. The high fuel pressure switch 74 and the low fuel pressure switch 75 act to turn the generator off if the fuel pressure departs from the range necessary for good combustion.

Delay timer 77 (FIG. 4) acts to delay the actuation of main fuel valve solenoid 78 for a selected time after actuation of the air compressor motor 79 and water valve solenoid 80, and also to delay actuation of the pilot fuel solenoid 81 and pilot spark 82 another, shorter, selected time after actuation of the main fuel valve solenoid and air compressor motor.

A flame detector 83 is mounted on the precombustion chamber in position to "see" the main flame once it is successfully ignited. (See FIGS. 1 and 3) It is preferably of the ultraviolet sensing type. As FIG. 4 illustrates, flame detector 83 is connected in the control system to cut off the pilot fuel solenoid and the pilot spark when the presence of the main flame is detected.

Recycle timer 84 is connected into the control system to monitor the elapsed time between initiation of a starting cycle and detection of the main flame. If no main flame is detected within a selected time, the recycle timer stops the attempt to fire the unit by opening main control relay 76, and then resets the relay to repeat the starting cycle one time. If no flame is detected at the end of the second attempt to start the equipment, recycle timer 84 opens relay 76 and holds it open. If desired, the same action may be used to sound an alarm.

As can be seen from FIG. 3, the water, fuel, and air lines are provided with various control valves. Thus the fuel line has manual cutoff valve 85, pressure regulator 86, safety shut off valve 87, check valve 88, and metering valve 89 mounted in it. The pilot fuel line is provided with metering valve 90. Air line is equipped with pressure relief valve 95 and check valve 96. The water line has cut off valve 92, check valve 93, and metering valve 94.

With the foregoing detailed description of the equipment of the invention in hand, an outline of its mode of operation can be given with reference to that description.

The starting sequence is as follows: assuming that each of the undesired condition monitors 71–75 is in "go" condition, operation of main switch 70 starts the air compressor motor 79 and opens the water valve 80. The generator is purged with air and water for a selected time, such as five seconds, to displace any uncombusted mixture therein. Delay timer 77 then operates to actuate pilot fuel solenoid 81 and pilot spark 82. After a further delay, such as one second, delay timer 77 operates to actuate main fuel valve solenoid 78.

When flame detector 83 detects the pressure of the main flame, it deactivates the pilot fuel solenoid and pilot spark.

If no flame is detected within a selected time, such as twelve seconds, recycle timer 84 opens relay 76, terminating the first starting effort. Timer 84 then resets relay 76, and the above starting sequence, beginning with the purge step, is repeated. If the second starting effort does not produce a flame, timer 84 opens relay 76 and holds it open.

Compressor 21 is driven to draw air in through compressor 21 and deliver it under pressure into conduit 23. The air stream is split into two parts at the juncture of conduits 24 and 25 with conduit 23. The proportioning of the air stream split is fixed by orifice plates 26 and 27, with the main portion of the air entering conduit 24, and a minor portion, 8–10 percent, entering conduit 25.

Just downstream in conduit 24 from orifice plate 26 fuel is introduced through line 28 at a rate sufficient to form a stoichiometric mixture with the air flowing through line 24. The turbulence downstream of plate 26 initiates good mixing of the fuel and air, and the relatively great length of conduit 24, including bend 29, insures thorough and intimate mixing.

The fuel-air mixture is delivered from conduit 24 into the top of precombustion chamber 30, where it is ignited. The initial ignition is by means of pilot burner 37 as explained above, and the flame 100 struck by it is self-sustaining. Ignition and maintenance of the flame are relatively easy, because the mixture being combusted within precombustion chamber 30 is essentially stoichiometric, that is relatively rich.

The auxiliary airstream is delivered through conduit 25 to annular space 36 of the precombustion chamber, where it cools shield 39 and is itself preheated. It flows through slot 35 into the main combustion chamber where it joins the portion of the flame 100. The addition of the excess air serves to lean out the flame and insure that sufficient oxygen is present to drive the combustion reactions to completion, and in particular to oxidize substantially all carbon to carbon dioxide. The lean flame at the entrance region of the main combustion chamber is shielded from excess quenching by the feed water by shield 38, to further assure complete combustion.

The flame 100 extends downwardly in the main combustion chamber past the bottom of shield 38, and its downward extension is in radiative and convective contact with the feed water flowing down the walls of tube 17. Good heat transfer occurs, and the water is vaporized to steam which joins the combustion products of the flame to exit through conduit 13.

What is claimed is:

1. A vapor generator comprising:

an enclosed combustion chamber;

means for delivering a mixture of fuel gas and combustion supporting gas to said combustion chamber;

means for delivering water to said combustion chamber for vaporization by heat derived from burning;

means for withdrawing combustion products and vaporized water from said combustion chamber;

a pilot burner positioned to deliver a pilot flame into said combustion chamber;

means for delivering a combustion supporting gas to said pilot burner;

means for delivering fuel gas to said pilot burner;

means for igniting the fuel gas in said pilot burner;

means for commencing delivery of combustion supporting gas and water to said combustion chamber at a first selected time;

means for commencing delivery of fuel gas to said pilot burner and for operating said igniting means at a second selected time later than said first selected time;

means for commencing delivery of fuel gas to said combustion chamber at a third selected time later than said second selected time;

means for detecting the presence of a flame in said combustion chamber;

means for disabling operation of said means for delivering fuel gas to said pilot burner and said pilot burner igniting means upon detection of a flame in said combustion chamber by said detecting means;

means for disabling operation of said means for delivering combustion supporting gas, fuel gas, pilot fuel gas, and said pilot fuel igniting means, at a fourth selected time later than said third selected time;

means for recommencing delivery of combustion supporting gas and water to said combustion chamber at a new first selected time following operation of said disabling means; and means for actuating each of said means for commencing delivery at a new selected second and third later times and for disabling operation of all of said means if no flame is detected in said combustion chamber after actuation thereof.

2. A method of starting a vapor generator of the kind in which fuel gas and combustion supporting gas are combusted in a closed combustion chamber in the presence of water to produce a product stream of vaporized water and combustion products, said method comprising:

commencing delivery of combustion supporting gas and water to said combustion chamber at a first selected time;

striking a pilot flame in said chamber at a second selected time later than said first selected time;

commencing delivery of fuel gas to said chamber at a third selected time later than said second selected time to establish a primary flame in said chamber;

detecting the primary flame established in said chamber;

extinguishing said pilot flame upon detection of said primary flame;

repeating the first three steps of said method if no primary flame is detected in said chamber at a fourth selected time later than said third selected time; and terminating delivery of fuel gas, combustion supporting gas, and water to said combustion chamber if no primary flame is detected in said chamber following said repetition of the first three steps of said method.

* * * * *